US006035683A

United States Patent [19]

Fournie et al.

[11] Patent Number: 6,035,683

[45] Date of Patent: Mar. 14, 2000

[54] METHOD OF CASTING AND ROLLING AND ROLL STAND ARRANGEMENT FOR ROLLING FINISHED SECTIONS (SHEET PILING SECTIONS) FROM A PRELIMINARY SECTION ARRIVING FROM A CONTINUOUS CASTING MACHINE AND HAVING APPROXIMATE FINAL DIMENSIONS

[75] Inventors: David A. Fournie; Lloyd M. Schmelzle, both of Desoto, Tex.; Georg Engel, Düsseldorf, Germany; Ulrich Svejkovsky, Wuppertal, Germany; Hans-Jürgen Nowak, Kamp-Lintfort, Germany

[73] Assignees: SMS Schloemann-Siemag Aktiengesellschaft, Dusseldorf, Germany; Chaparral Steel, Midlothian, Tex.

[21] Appl. No.: 09/112,709

[22] Filed: Jul. 9, 1998

[30] Foreign Application Priority Data

Jul. 12, 1997 [DE] Germany ..... 197 29 991

[51] Int. Cl.[7] ..... B21B 41/06

[52] U.S. Cl. ..... 72/229

[58] Field of Search ..... 72/247, 229, 225, 72/224, 226, 366.2, 365.2

[56] References Cited

U.S. PATENT DOCUMENTS 4,184,353 1/1980 Sebardt et al. ..... 72/247

4,791,799 12/1988 Engel et al. ..... 72/229

4,860,426 8/1989 Engel et al. ..... 72/229

*Primary Examiner*—Rodney A Butler

*Attorney, Agent, or Firm*—Friedrich Kueffner

[57] ABSTRACT

A method of casting and rolling and a roll stand arrangement for rolling finished sections (sheet piling sections) from a preliminary section which arrives from a continuous casting machine and has approximate final dimensions. The method utilizes roll stand arrangements which operate in a rolling line in a reversing operation. A roughing rolling group has in a first rolling line a runout roller table and a transverse transport device following the runout roller table and in a second rolling line a parallel run-in roller table for a compact tandem stand group. A horizontal stand of the roughing rolling group and/or an intermediate edging stand of the compact tandem stand group each have two selectable grooves, wherein a universal stand on the exit side of the compact tandem group has one or more two-high horizontal stands with grooved rolls. When rolling with this stand arrangement, for adjusting the width and for adjusting the shape of a preliminary section having a H-shaped cross-section while simultaneously reducing the cross-section in the roughing rolling group, further reduction of the cross-section with deformation of section ends for forming interlocks is carried in the compact tandem stand group and a final finish-shaping of the interlocks of the section is carried out in the grooves of the two-high horizontal stands.

3 Claims, 3 Drawing Sheets

METHOD OF CASTING AND ROLLING AND ROLL STAND ARRANGEMENT FOR ROLLING FINISHED SECTIONS (SHEET PILING SECTIONS) FROM A PRELIMINARY SECTION ARRIVING FROM A CONTINUOUS CASTING MACHINE AND HAVING APPROXIMATE FINAL DIMENSIONS

BACKGROUND OF THE INVENTION

1. Field of the Invention

The present invention relates to a method of casting and rolling and a roll stand arrangement for rolling finished sections (sheet piling sections) from a preliminary section which arrives from a continuous casting machine and has the approximate final dimensions. The method utilizes roll stand arrangements which operate in a rolling line in a reversing operation. The roll stand arrangements include a compact rolling group composed of a first universal stand at an entry side and a second universal stand at an exit side and an intermediate edging stand arranged between the universal stands, wherein a roughing rolling group composed of vertical roll stands and horizontal roll stands is arranged in front of the compact rolling group. For rolling the sheet piling sections, with one of the roll stands of the roughing rolling group and one of the roll stands of the compact rolling group being equipped with selectable grooves which can be optionally moved into and out of the rolling line, shaping of the preliminary section in the roll stands of the roughing group is carried in a number of shape changing passes and shape reduction passes, and subsequently further shaping of the section is carried in the compact rolling group in several shape changing passes or shape reduction passes and reversing passes in the universal stand on the entry side and in the intermediate edging stand with or without the use of the selectable grooves, wherein the compact rolling group operates as a tandem stand group.

2. Description of the Related Art

The rolling of sheet piling sections has in the past always been carried out with reversing operations in rolling trains with individual stands and free runout of the roll stand because the large number of shaping grooves necessary for the roughing rolling of such sections required large reversing roll stands with great lengths of the bodies of the rolls for accommodating the number of shaping grooves. These large stands and the rolls themselves, as well as the necessary manipulating devices for introducing the rolling stock into the various grooves are very complicated, require a large amount of space and have relatively low throughput capacities. The large quantities of rolling stock themselves lead to relatively long rolling times during reversing rolling and they practically do not make it possible to operate such plants in a timed sequence with a continuous casting machine. For this reason, relatively large intermediate storage facilities are required when continuous casting plant and rolling mill are used together.

Therefore, for rolling of sheet piling sections, it has already been proposed in a not prepublished older patent application to use a compact rolling group composed of a tandem stand each on the entry side and the exit side each having two-high roll pairs with two or more grooves and corresponding transverse shifting devices for the rolling stock and an intermediate edging stand with or without selectable grooves arranged between the two tandem stands, wherein the preshaped preliminary section is shaped in a section-changing manner in the universal stand possibly equipped with profiled horizontal rolls and in the horizontal two-high stand of the roughing rolling group also possibly equipped with profiled horizontal rolls in several reversing passes between the two roll stands,a nd the section is subsequently finish-shaped in a reversing operation in the grooves of the two tandem stands with or without the inclusion of a pass in the intermediate edging stand having profiled rolls.

However, these and similar methods and roll stand arrangements make it only possible to achieve relatively small productions and the guidance of the section already shaped by rolling in the tandem stands posed technical difficulties. It is essentially only possible to produce sheet piling sections having U-shaped cross-sections, but not those with Z-shaped cross-sections for which there is a great demand today in various markets.

SUMMARY OF THE INVENTION

Therefore, it is the primary object of the present invention to improve the known method for casting and rolling and the roll stand arrangement for rolling sheet piling sections in such a way that the above-described disadvantages and difficulties are eliminated and rolling of sheet piling sections having U-shaped cross-sections, as well as those having Z-shaped cross-sections is made possible in all sizes and with a good efficiency of the roll stand arrangement.

In accordance with the present invention, the roughing rolling group has in a first rolling line a runout roller table and a transverse transport device following the runout roller table and in a second rolling line a parallel run-in roller table for the compact tandem stand group. The horizontal stand of the roughing rolling group and/or the intermediate edging stand of the compact tandem stand group each have two selectable grooves, wherein the universal stand on the exit side of the compact tandem group has one or more two-high horizontal stands with grooved rolls. When rolling with this stand arrangement, for adjusting the width and for adjusting the shape of a preliminary section having a H-shaped cross-section while simultaneously reducing the cross-section in the roughing rolling group, further reduction of the cross-section with deformation of section ends for forming interlocks is carried in the compact tandem stand group and a final finish-shaping of the interlocks of the section is carried out in the grooves of the two-high horizontal stands.

The above-described configuration of roll stands and the manner of operation thereof make it possible to produce U-sections having substantially varying heights as well as Z-sections for sheet pilings including the different interlock shapes at the ends thereof while ensuring a very good rolling efficiency.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
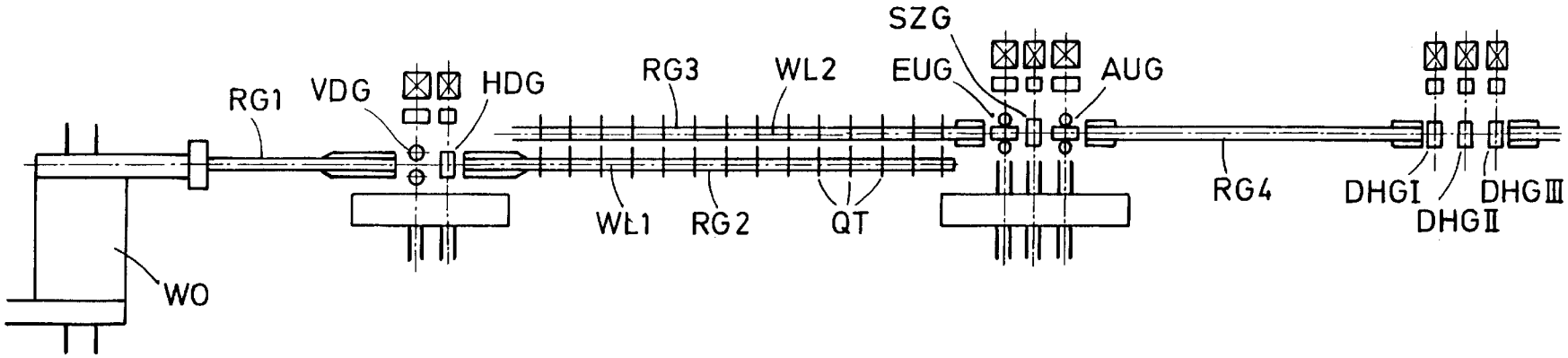
FIG. 1 is a schematic top view of a roll stand arrangement.

As can be seen in FIG. 1, following a heating furnace WO which also may be a reheating furnace connected directly to the continuous casting plant for heating the strand sections which are hot from the continuous casting to rolling temperature, a roller table RG1 is arranged which leads to a roughing stand group which on the entry side is composed of a vertical two-high stand VDG and on the exit side of a horizontal two-high stand HDG. In the same rolling line WL1, this group of roughing roll stands is followed by a roller table RG2. A transverse conveying unit QT leads to a parallel roller table RG3 which in a second rolling line WL2 leads to the compact tandem stand group composed of a universal stand EUG on the entry side, an intermediate edging stand SZG and a universal stand AUG on the exit side and followed by a roller table RG4 which leads in the same rolling line WL2 to the successively arranged two-high horizontal stands DHG1, DHG2 and DHG3 which are equipped with profiled rolls.

Figure 2:
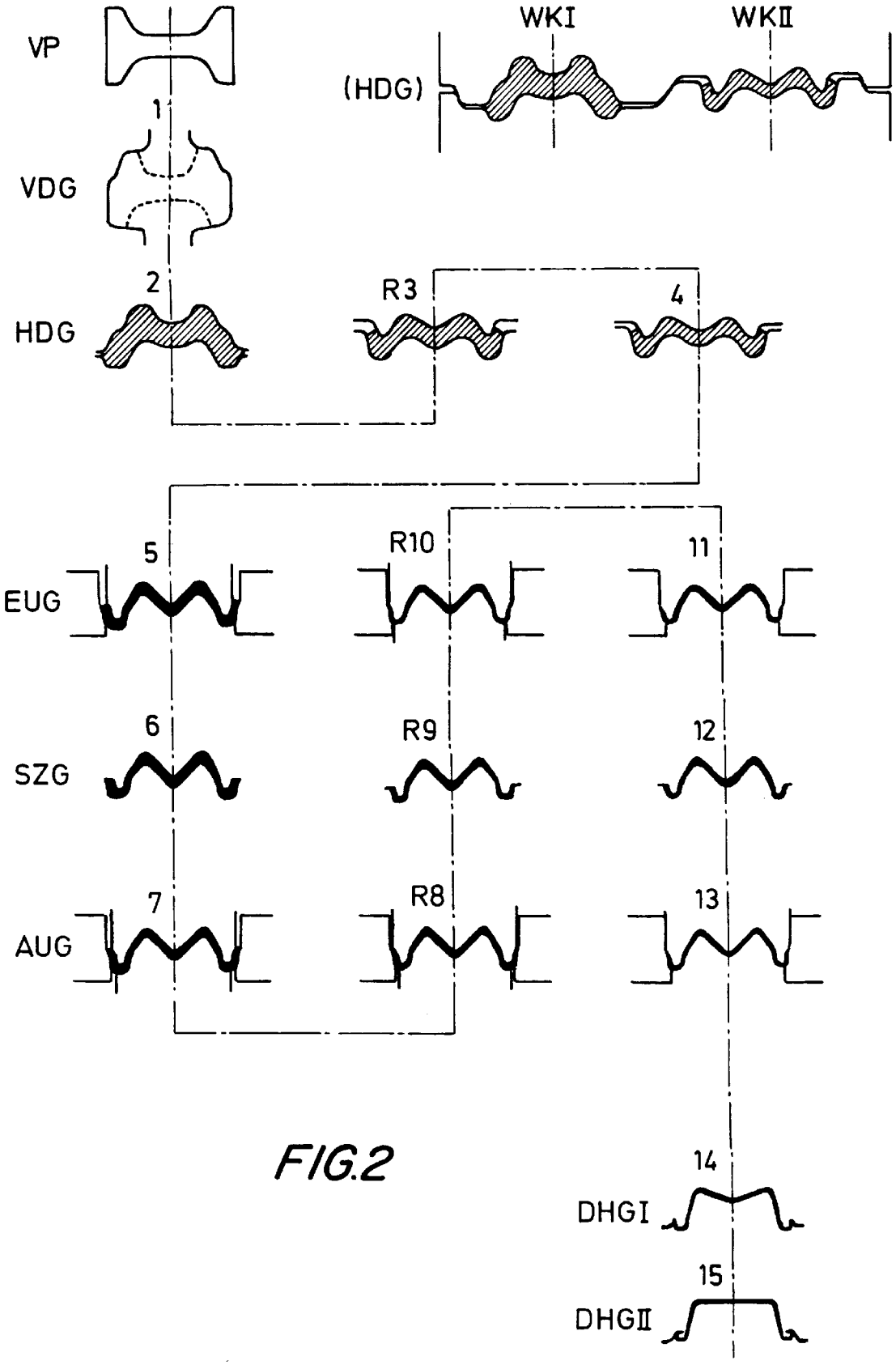
FIG. 2 is a pass schedule for the roll stand arrangement of FIG. 1.

As illustrated in FIG. 2, the preliminary section VP is edged in a first pass 1 in the vertical two-high stand VDG and is shaped in a subsequent pass 2 in the selectable groove WKI of the horizontal two-high stand HDG and is then reduced in a reversing pass R3 and a subsequent pass 4 in the selectable groove WKII. This is then followed by a continuous sequence of three passes 5, 6 and 7 through the universal stand EUG on the entry side, the intermediate edging stand SZG and the universal stand AUG on the exit side of the compact tandem stand group, followed by the reversing passes R8, R9 and R10 in the reverse direction and reverse sequence of the stands, and followed by renewed passage with the subsequent passes 11, 12 and 13 through the same row of stands. The finished basic shape of the sheet piling section achieved in a reducing operation in these tandem pass sequences is finish-shaped in immediately following successive passes 14 and 15 in the grooves of the two-high horizontal stands DHGI and DHGII so as to finally shape the interlock ends.

Figure 3:
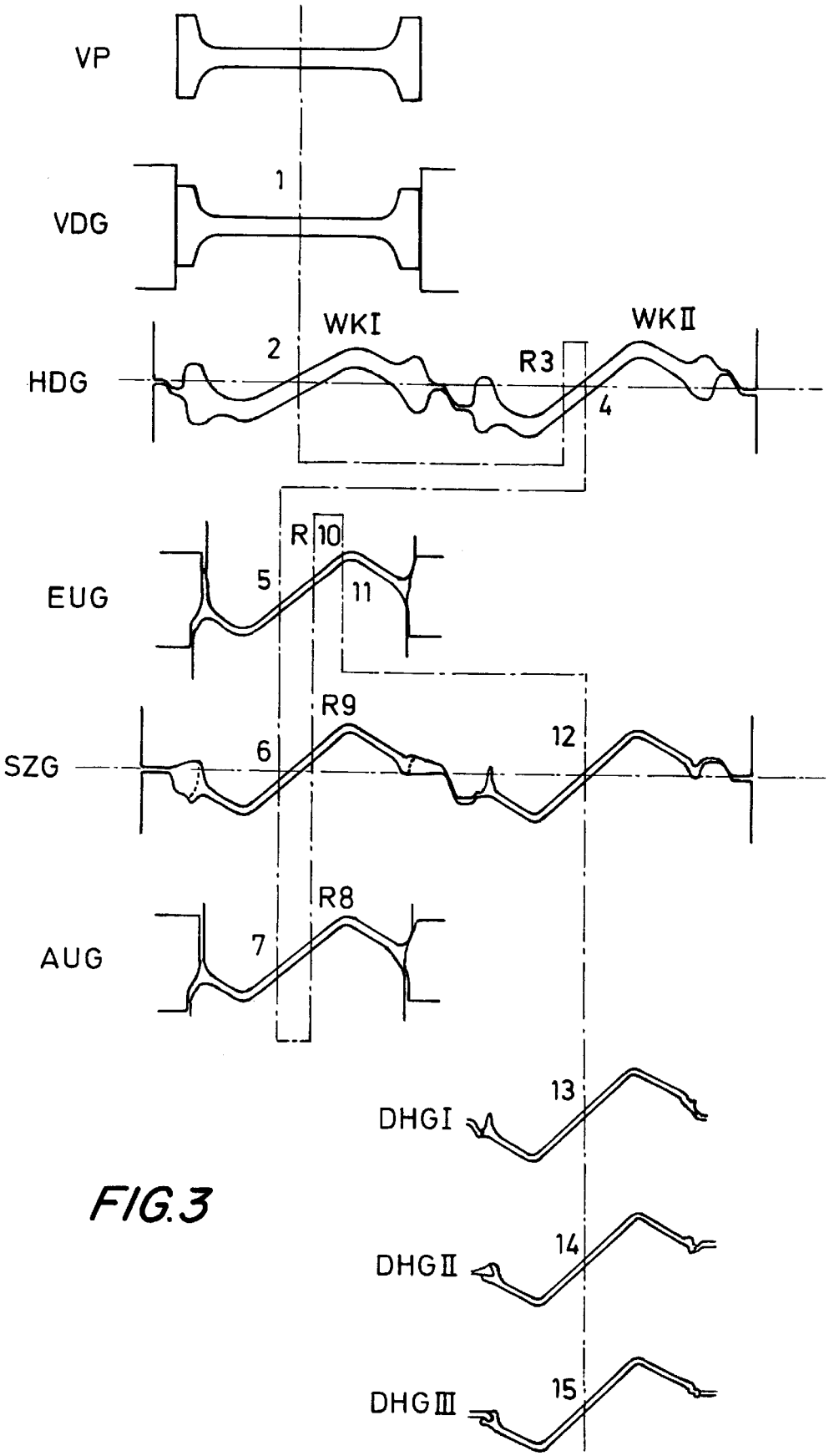
FIG. 3 is another pass schedule for the roll stand arrangement of FIG. 1.

In the pass schedule according to FIG. 3, the preliminary section VP is also edged in a first pass 1 in the vertical two-high stand VDG and is subsequently preshaped in a subsequent pass 2 through the horizontal two-high stand HDG of the roughing rolling group in the selectable groove WKI thereof. This shape is reduced in a reversing pass R3 and another pass R4 through the selectable groove WKI thereof. This shape is reduced in reversing pass R3 and another pass 4 through the selectable groove WKII and is further reduced in a pass sequence 5, 6 and 7 through the universal stand EUG on the entry side, the intermediate edging stand SZG and the universal stand AUG on the exit of the compact tandem stand group and a subsequent reversing pass sequence R8, R9 and R10 and a following pass 11 through the universal stand EUG on the entry side and is finally preshaped in a pass 12 through the second selectable groove of the intermediate edging stand SZG. The interlock ends of the sheet piling section finish-rolled in its basic shape in this manner are finish-rolled immediately subsequently in a continuous pass sequence 13, 14, 15 in the two-high horizontal stands DHGI, DHGII and DHGIII.

While specific embodiments of the invention have been shown and described in detail to illustrate the inventive principles, it will be understood that the invention may be embodied otherwise without departing from such principles.

We claim:

1. A method of casting and rolling Z-sections for sheet piling sections from a preliminary section which arrives from a continuous casting machine and has approximate final dimensions, the method utilizing roll stand arrangements operating in a rolling line in a reversing operation, the roll stand arrangements including a compact rolling group composed of a first universal stand at an entry side and a second universal stand at an exit side and an intermediate edging stand arranged between the universal stands, a roughing rolling group composed of vertical roll stands and horizontal roll stands being arranged in front of the compact rolling group, wherein, for rolling the sheet piling sections, with one of the roll stands of the roughing rolling group and one of the roll stands of the compact rolling group being equipped with selectable grooves configured to be moveable into and out of the rolling line, the method comprising shaping the preliminary section in the roll stands of the roughing group in a number of shape changing passes and shape reduction passes, subsequently further shaping the section in the compact rolling group in several shape changing passes or shape reduction passes and reversing passes in the universal stand on the entry side and in the intermediate edging stand with or without the use of the selectable grooves, wherein the compact rolling group operates as a tandem stand group, wherein the roughing rolling group has in a first rolling line a runout roller table and a transverse transport device following the runout roller table and in a second rolling line a parallel run-in roller table for the compact tandem stand group, and the horizontal stand of the roughing rolling group and the intermediate edging stand of the compact tandem stand group each have first and second selectable grooves, and wherein a group of two-high horizontal stands is arranged at a distance following the universal stand on the exit side of the compact tandem group and each of the two-high horizontal stands has grooved rolls, further comprising, for adjusting a width and for adjusting a shape of a preliminary section having a H-shaped cross-section while simultaneously reducing the cross-section in the roughing rolling group, carrying out further reduction of the cross-section with deformation of section ends for forming a basic shape of interlocks of the Z-section in the compact tandem stand group and carrying out a final finish-shaping of the interlocks of the Z-section in the grooves of the group of two-high horizontal stands.

2. The method according to claim 1, comprising edging the preliminary section in the preliminary stand of the roughing rolling group in one pass, subsequently shaping the section in a subsequent pass in the first selectable groove of the horizontal stand of the roughing rolling group, rolling in a shape-reducing manner in a subsequent reversing pass and a subsequent pass in the second selectable groove, and then rolling in a shape-reducing manner in three successive pass sequences and reversing pass sequences through all stands of the compact tandem stand group and in a subsequent sequence of passes in the two-high horizontal stands in order to form the finished basic shape of sheet piling with interlock ends.

3. The method according to claim 1, comprising edging the preliminary section in the vertical stand of the roughing rolling group in one pass, subsequently shaping and shape-reducing the section in a pass, a reversing pass and a subsequent pass in the horizontal stand, and then further reducing the section in the compact tandem stand group using the first selectable groove of the intermediate edging stand of this stand group in three subsequent passes and reversing pass sequences successively through all stands of the compact tandem stand group and a subsequent pass again through the universal stand on the entry side, subsequently carrying out another shape-reducing pass through the second selectable groove of the intermediate edging stand to obtain a basic shape of sheet piling, and then immediately subsequently finish-rolling interlock ends of the section in successive passes through the grooved rolls of the two-high horizontal stands.

* * * * *